United States Patent [19]

Meder

[11] Patent Number: 4,620,573

[45] Date of Patent: Nov. 4, 1986

[54] TWISTED PAIR WIRE SEPARATOR

[75] Inventor: Gregg T. Meder, Downingtown, Pa.

[73] Assignee: Burroughs Corporation, Detroit, Mich.

[21] Appl. No.: 718,480

[22] Filed: Apr. 1, 1985

[51] Int. Cl.[4] ..... B21F 15/02

[52] U.S. Cl. ..... 140/123; 72/211; 140/147

[58] Field of Search ..... 7/107, 125, 128, 158; 29/268; 81/9.43, 418, 424.5, 427; 140/123, 52, 106, 117, 123.5, 147; 72/211

[56] References Cited

U.S. PATENT DOCUMENTS

| | | | |
|---|---|---|---|
| 644,932 | 3/1900 | Miller | 72/211 |
| 1,317,627 | 9/1919 | Kennedy | 72/211 |
| 3,543,616 | 12/1970 | Bradley | 7/107 |
| 3,875,601 | 4/1975 | Kaufman | 7/107 |
| 4,132,251 | 1/1979 | Folk et al. | 140/147 |

FOREIGN PATENT DOCUMENTS

| | | | |
|---|---|---|---|
| 38585 | 6/1931 | France | 72/211 |

*Primary Examiner*—Francis S. Husar
*Assistant Examiner*—Robert Showalter
*Attorney, Agent, or Firm*—Francis A. Varallo; Kevin R. Peterson

[57] ABSTRACT

The present disclosure describes a tool having a pliers-like configuration for separating the wires of a twisted pair. The tool employs a pair of rotatable, tubular jaws for effecting the separation of the wires as the twisted pair is drawn therethrough. More than one pair of twisted wires may be separated simultaneously if desired. The rotating action of the tubular jaws minimizes operator fatigue, eliminates stretch damage to the wire insulation and reduces wear of the jaw surfaces, which are preferably formed of a resilient material.

4 Claims, 3 Drawing Figures

TWISTED PAIR WIRE SEPARATOR

BACKGROUND OF THE INVENTION

The fabrication of electronic equipment, such as data processors, often involves assembly operations in both wrapped wire connections and cable and harness layouts. When such operations entail the use of twisted pairs of wires, it is necessary that each twisted pair be separated prior to electrical termination.

In order to make the task of untwisting wires less tedious and time consuming, a number of methods and devices have been developed to assist an operator. One such device for both untwisting a pair of wires and for stripping the portions of the separated wires is described in U.S. Pat. No. 3,736,606 to John F. Raum et al. In this patent, the tool body or handle includes a pair of fixed projections having respective rounded edges and defining a slot for receiving the twisted pair. As the wires are pulled between the projections, they are separated from each other. However, the untwisting and stripping functions of the tool are interdependent. A stripping blade mounted on a slideable member moves along with the wires relative to the tool body, from a first position, where the untwisting projections and the stripping blade are contiguous, to a second position controlled by a stop in the slide mechanism. Continued pulling of the wire after this second position has been reached, results in subtantially the entire length of the separated wires being stripped of insulation.

A later issued U.S. Pat. No. 3,875,601 to H. Kaufman, references the former patent and describes an "improved" tool for untwisting, cutting and stripping twisted wire pairs. A feature of the last mentioned tool is the use of untwister jaws comprised of a fixed jaw and a pivotable jaw which is operator actuated to apply pressure to the twisted wire as it is drawn between the jaws. The untwisting and stripping functions are substantially identical to those described hereinbefore in connection with the earlier patent.

The known tools are adapted to separate only one twisted pair at a time, which makes them inefficient when pluralities of twisted pairs are to be separated. Also, the degree of pressure applied to the twisted pair as they are separated may be detrimental. Thus, the pressure applied to the twisted pair insulation by the fixed projections of the Raum et al. tool will vary with the wire gauge and the spacing of the projections. On the other hand, the pressure applied to the twisted pair in the Kaufman tool is a function of the operator's actuation of the pivotable jaw in relation to the fixed jaw. In either case, excessive pressure may result in the stretching of the wire insulation, rendering the wire unusable.

What is desired is a twisted pair wire separator which is easy to operate and requires only slight pressure applied by an operator; which is capable of untwisting any desired length of wire; which can untwist one pair or a plurality of twisted pair simultaneously; which requires no adjustment for wires of different gauges; and which is maintenance free and wear-resistant. The wire separator of the present invention meets all of these requirements.

SUMMARY OF THE INVENTION

In accordance with the present invention, a tool is provided for untwisting pairs of wires which are part of a cable and harness assembly or which are to be disposed upon electrical terminals in a wire-wrapping operation.

The tool exhibits a pliers-like configuration and is comprised of a pair of members pivotally disposed with respect to each other. Each of the last mentioned members includes a handle section at one extremity thereof, a U-shaped section at the opposite extremity thereof, and a crosspiece oriented transverse to the principal longitudinal axes of the sections, for coupling the latter to each other in a parallel, spaced-apart manner. A tubular roller jaw is rotatably mounted in each of the U-shaped sections and extends beyond the confines of the legs of the "U". When the tool is assembled, the U-shaped sections are arranged in opposition to each other. The pair of roller jaws are normally biased to an open position by spring means coupled to the U-shaped sections. Movement of the handle sections toward each other operates, via a pivot linking the crosspieces, to bring the respective surfaces of the roller jaws into substantially uniform contact with each other along their entire lengths. The roller jaws are preferably made of Teflon tubing or other materials covered by plastic or Teflon. The resilient nature of Teflon tends to prevent damage to the wire insulation during separation. The susceptibility to wear of Teflon, as noted in the aforementioned Kaufman patent, is essentially overcome in the separator of the present invention because of the rolling action of the jaws over the wire. Additionally, the use of rolling jaws eliminates the stretching of the wire insulation as it is drawn therethrough.

In using the tool, the operator grasps the handle sections in one hand and places one twisted pair or several pairs between the open roller jaws with the other hand. Then, the handle sections are depressed to close the jaws and to maintain a slight pressure on the wires. Thereafter, the operator draws the portion of the wires to be untwisted through the roller jaws which rotate in opposite directions about their respective longitudinal axes. The application of rolling pressure to the twisted pair forces both wires to remain in the same plane, effecting the untwisting of the wires. It is apparent that any length of wire may be untwisted in this manner. For example, it is not unusual in an actual manufacturing environment in which the present tool has been used, to separate wire lengths of ten inches or more prior to electrical termination. In connection with the latter, a stripped end length of approximately one inch is all that is required and is performed in a conventional manner.

Other features and advantages of the separation tool of the present invention will become apparent in the detailed description which follows.

DESCRIPTION OF THE PREFERRED EMBODIMENT

Figure 1:
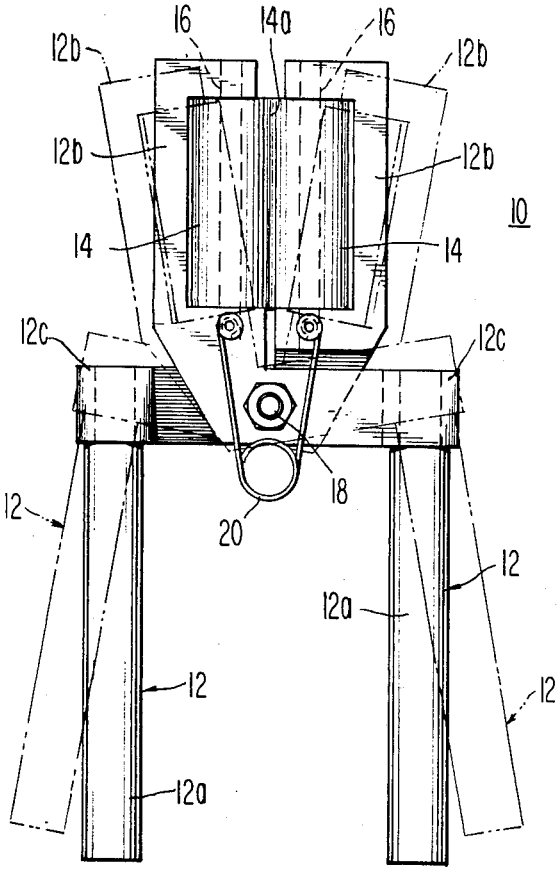
FIG. 1 is a front view of the twisted pair wire separator of the present invention.
Figure 2:
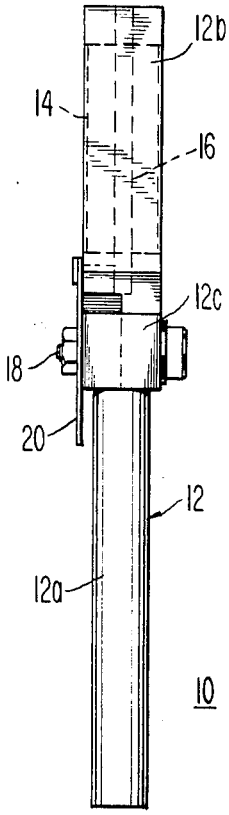
FIG. 2 is a side view of the wire separator.

FIGS. 1 and 2 illustrate respectively a front and a side view of the twisted pair wire separator tool 10 of the present invention. Thus, the tool 10 is comprised of a pair of members 12 arranged in pliers-like fashion. Each member 12 is comprised of an integral handle section **12*a* at one extremity thereof, a U-shaped section 12*b* at the opposite extremity and a crosspiece 12***c* coupling the last mentioned sections to each other. A tubular roller jaw 14, associated with each member 12, is rotatably mounted on a shaft 16 bridging the legs of the U-shaped section 12*b*. In the assembled tool, the members 12 are linked to each other by a pivot 18 disposed in the crosspieces 12*c*. The pair of roller jaws 14 are biased to an open position by a hairpin spring 20 having extremities affixed respectively to the surfaces of the U-shaped sections 12*b*. When the handle sections 12*a* are moved toward each other, about pivot 18, the respective surfaces 14*a* of the roller jaws 14 which are external to the envelopes defined by the U-shaped sections 12*b*, contact each other substantially uniformly along their entire lengths. In actual operative embodiments of tool 10, the roller jaws 14 are formed of Teflon tubing.

Figure 3:
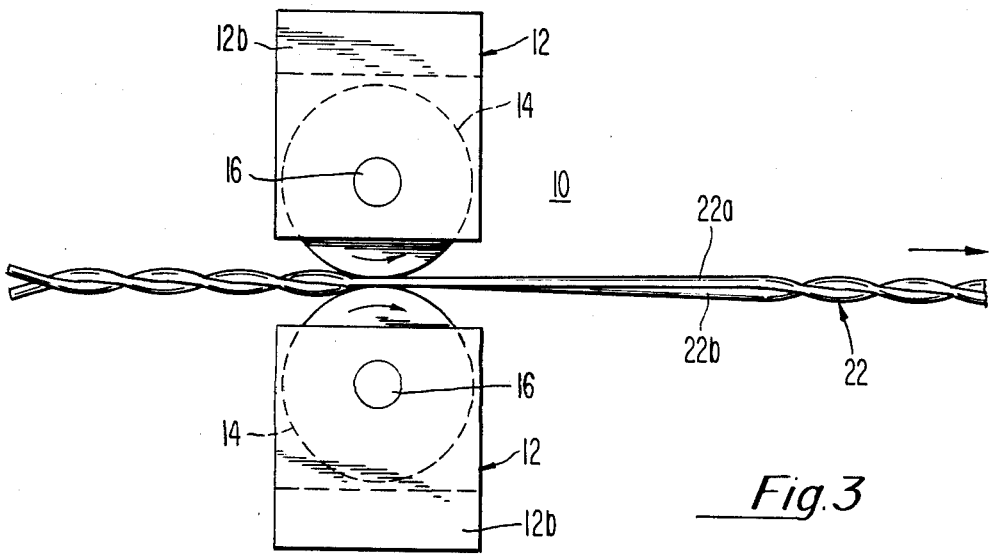
FIG. 3 is a plan view of the wire separator illustrating in particular the untwisting of a twisted wire pair disposed in its closed roller jaws.

With continued general reference to FIGS. 1 and 2 and specific reference to FIG. 3, the operation of the tool will be described. The operator grasps the handle sections 12*a* in one hand and places one twisted wire pair 22 (or several pairs, if desired) between the open roller jaws 14 of the tool 10, with the other hand. The operator then squeezes the handle sections 12*a* gently to close the jaws 14 upon the twisted wire and to apply a light pressure thereto. The wire is then drawn through the roller jaws 14 which rotate about their respective shafts 16 in the directions shown by the arrows. As the twisted pair wire 22 exits the roller jaws 14, the wires 22*a* and 22*b* are untwisted or separated. It is apparent that any length of twisted pair may be easily and quickly separated, as required for electrical terminations in the equipment being fabricated.

In conclusion, there has been described a tool for untwisting twisted pair electrical conductors which has been successfully used by operators in the production of electronic data processors. The rolling pressure applied by the jaws of the present tool in wire separation requires only slight manual force applied to the tool handle sections and thus minimizes operator fatigue. The tool capability of separating more than one twisted wire pair simultaneously, results in increased production efficiency. Also, the rolling action of the jaws prevents the stretching of the wire insulation over the electrical conductor and insures a long life for the roller surfaces.

In accordance with the description of the invention given herein, it is apparent that depending upon the particular application, changes and modifications of the tool may be required. Such changes and modifications, insofar as they are not departures from the true scope of the invention, are intended to be covered by the following claims.

What is claimed is:

1. A twisted pair wire separator comprising:

a pair of members arranged in pliers-like fashion, each of said member including a handle section at one extremity thereof, a U-shaped section at the opposite extremity thereof, and a crosspiece intermediate said last mentioned sections, the principal longitudinal axes of said handle section and said U-shaped section being oriented parallel to each other, said crosspiece of each of said members being disposed transversed to said longitudinal axes and coupling the last mentioned sections to each other in spaced-apart relation, means disposed in common in the respective crosspieces of said pair of members for pivotably linking said members to each other, the U-shaped sections of the respective members being oriented in opposition to each other, a pair of right circular cylindrical tubular jaws rotatably mounted in respective ones of said U-shaped sections, whereupon the movement of the handle sections of said members toward each other tends to cause said tubular jaws to contact each other along their longitudinal axes, and whereby a rolling pressure exerted upon at least one twisted wire pair disposed between said tubular jaws and being drawn therethrough effects a separation of the wires in said pair.

2. A twisted pair wire separator as defined in claim 1 further characterized in that each of said U-shaped sections includes a shaft affixed between the legs of the "U" for rotatably supporting one of said tubular jaws, said shaft being positioned such that the surface of the tubular jaw extends beyond the spatial envelope defined by said legs of said "U".

3. A twisted pair wire separator as defined in claim 2 further including a spring coupled to said U-shaped sections of said members for biasing said tubular jaws in an open position.

4. A twisted pair wire separator as defined in claim 3 wherein at least the surface of said tubular jaws is formed of Teflon material.

* * * * *